US011958577B1

(12) United States Patent
Katz

(10) Patent No.: US 11,958,577 B1
(45) Date of Patent: Apr. 16, 2024

(54) MODULAR BOAT

(71) Applicant: Moshe Katz, Kfar Malal (IL)

(72) Inventor: Moshe Katz, Kfar Malal (IL)

( * ) Notice: Subject to any disclaimer, the term of this patent is extended or adjusted under 35 U.S.C. 154(b) by 0 days.

(21) Appl. No.: 18/203,618

(22) Filed: May 30, 2023

(51) Int. Cl.
*B63B 7/08* (2020.01)
*B63H 1/14* (2006.01)
*B63H 25/02* (2006.01)

(52) U.S. Cl.
CPC ..... *B63B 7/08* (2013.01); *B63H 1/14* (2013.01); *B63H 25/02* (2013.01); *B63H 2025/024* (2013.01)

(58) Field of Classification Search
CPC .. B63B 7/08; B63H 1/14; B63H 25/02; B63H 2025/024
See application file for complete search history.

(56) References Cited

U.S. PATENT DOCUMENTS 1,761,883 A * 6/1930 Froedtert ..... B63H 16/14 440/30
1,761,884 A * 6/1930 Gorski ..... B63H 16/14 440/30
3,709,185 A * 1/1973 Hennel ..... B63H 21/175 114/162
5,297,978 A * 3/1994 Ramsey ..... B63C 13/00 441/131
5,474,481 A * 12/1995 Ramsey ..... B63C 13/00 224/406
10,793,233 B1 * 10/2020 Morgan ..... B63C 11/26

FOREIGN PATENT DOCUMENTS

CN 105691562 A * 6/2016 ..... B63B 34/50
CN 105691562 A 6/2016
FR 2772337 A1 * 6/1999 ..... B63B 7/082
KR 200485391 Y1 * 1/2018 ..... B63H 25/38
KR 200485391 Y1 1/2018
WO WO-2018129668 A1 * 7/2018 ..... B60F 3/00

* cited by examiner

*Primary Examiner* — S. Joseph Morano
*Assistant Examiner* — Jovon E Hayes
(74) *Attorney, Agent, or Firm* — Reches Patents

(57) ABSTRACT

A modular boat that includes a main body that is hollow and has suitcase like dimensions; inflatable floating elements that are detachable coupled to the main body via first mechanical interfaces; a boat control unit that is movably coupled to the main body and is configured to move between a first position to a second position, the first and second positions differ from each other by at least a distance of a distal part of the boat control unit from the main body; a propulsion unit; wherein a when the modular boat is at a disassembled state, the one or more inflatable floating elements are not detachably coupled to the main body.

21 Claims, 6 Drawing Sheets

90

MODULAR BOAT

BACKGROUND OF THE INVENTION

Boats are usually hard to convey from their storage to water due to their substantial size.

Korean Patent KR200485391 titled "a sectional boat" describes a carrier type pre-fabricated boat that may be housed in a carrier type bag and can be assembled before reaching the water. The boat assembly is complex and includes a body member, a partition plate and many other parts that are stored in the body member and are to be assembled during the assembly of the bot—including a chair, a fixed post, a propellor, laying plates, and rudder. The body member itself is complex and includes rotatable doors and a cicada ring for locking the doors, the doors form a part of the boat when assembled. Having a relatively large number of mechanical elements that should be assembled increases the risk of losing some of the parts—and also reduces the durability of the sectional boat.

CN patent application CN105691562A titled "portable water bicycle" describes a portable water bicycle that can assembled before reaching the water. The portable water bicycle includes (i) a foldable frame that includes a left shell, a right shell, (ii) a multiple joint foldable mechanical unit that includes a seat cushion, a seat arm, a rear base, a handle, a front base, and a directional arm, and (iii) a foldable unit that includes a rudder, lower cross member, a gearbox, a motor and a propeller. The portable water bicycle also include right and left airbags. The assembly of the portable water bicycle is complex. Having a relatively large number of mechanical elements that should be unfolded during the assembly—and especially having the main frame of the portable water bicycle made of different parts—reduces the durability of the sectional boat.

There is a growing need to provide a boat that is more durable and is easier to assemble.

SUMMARY

There may be provided a modular boat that may include a main body that is hollow and has suitcase like dimensions; inflatable floating elements that are detachable coupled to the main body via first mechanical interfaces; a boat control unit that is movably coupled to the main body and is configured to move between a first position to a second position, the first and second positions differ from each other by at least a distance of a distal part of the boat control unit from the main body; and a propulsion unit. When the modular boat is at a disassembled state, the one or more inflatable floating elements are not detachably coupled to the main body.

The main body may include wheels.

The main body may include a storage space for storing the one or more inflatable floating elements.

The distal part of the boat control unit may be a handle.

The handle may be mechanically coupled to a rotatable element that may be rotatable, by the handle, about a yaw axis.

The rotatable element may be also rotatable about a pitch axis, between the first position and the second position.

The handle may be mechanically coupled to a rod having an adjustable height.

The boat control unit may be configured to form a handle of the modular boat when the modular boat may be at the disassembled state.

The modular boat may include an inflating unit that may be configured to inflate the one or more inflatable floating elements.

The main body may be configured to store the one or more inflatable floating elements, when the modular boat may be at the disassembled state.

The main body may include recesses for receiving the first mechanical interfaces.

The modular boat may include a chair.

The chair may be a height adjustable chair.

The propulsion unit may include a first portion that may include propellers, wherein the first portion may be configured to move between a third position and a fourth position, wherein the third and fourth positions differ from each other by at least a distance of the propellers from the main body.

The propellers are at least partially surrounded by the main body when the first portion may be positioned at the third position.

The modular boat may include a step or a ladder.

The main body may include a curved upper surface.

The modular boat may include a power unit.

The modular boat may include a power unit that may be located within the main body.

The main body may be non-foldable.

The main body may include a rigid one-part exterior frame.

BRIEF DESCRIPTION OF THE DRAWINGS

The subject matter regarded as the invention is particularly pointed out and distinctly claimed in the concluding portion of the specification. The invention, however, both as to organization and method of operation, together with objects, features, and advantages thereof, may best be understood by reference to the following detailed description when read with the accompanying drawings in which:

DETAILED DESCRIPTION OF THE DRAWINGS

Figure 1:
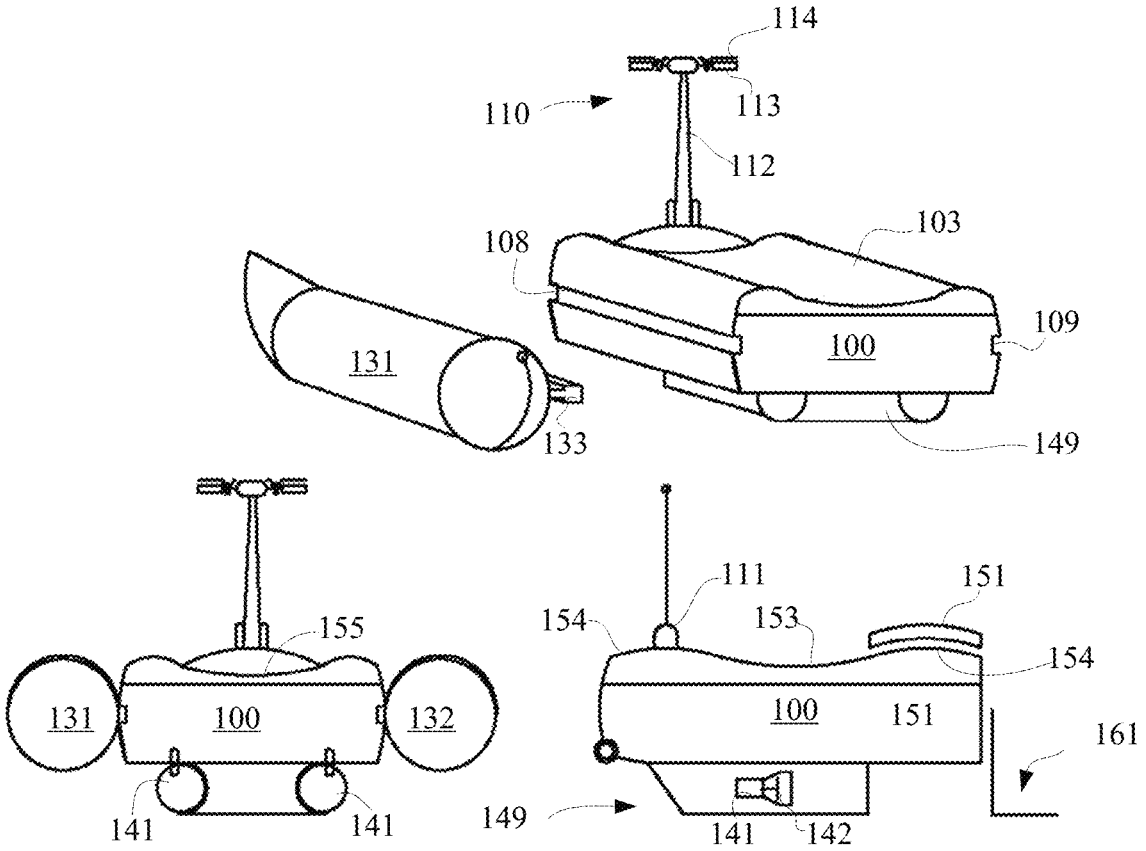
FIGS. 1-6 illustrate multiple views of examples of a modular boat.
Figure 2:
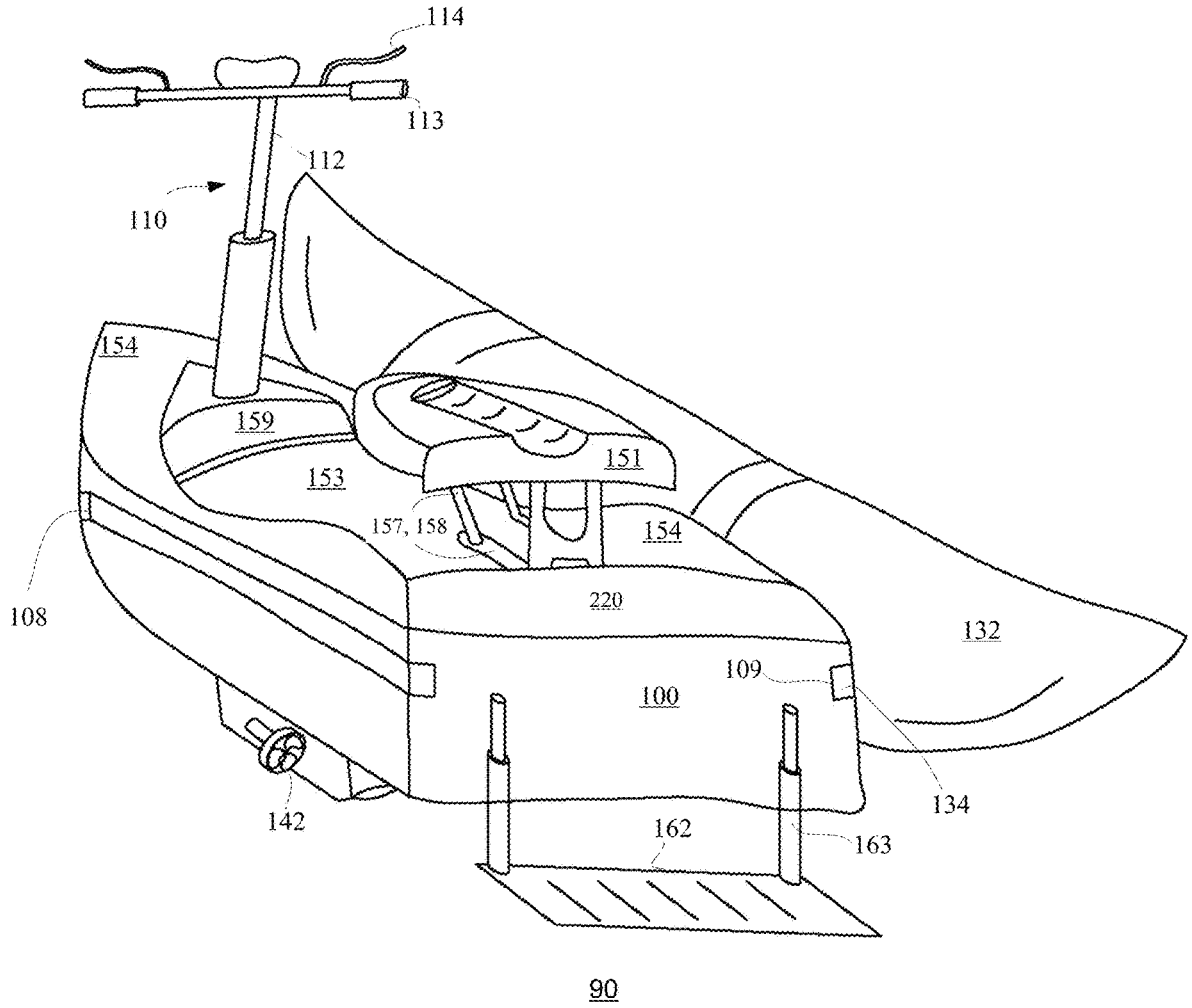
Figure 3:
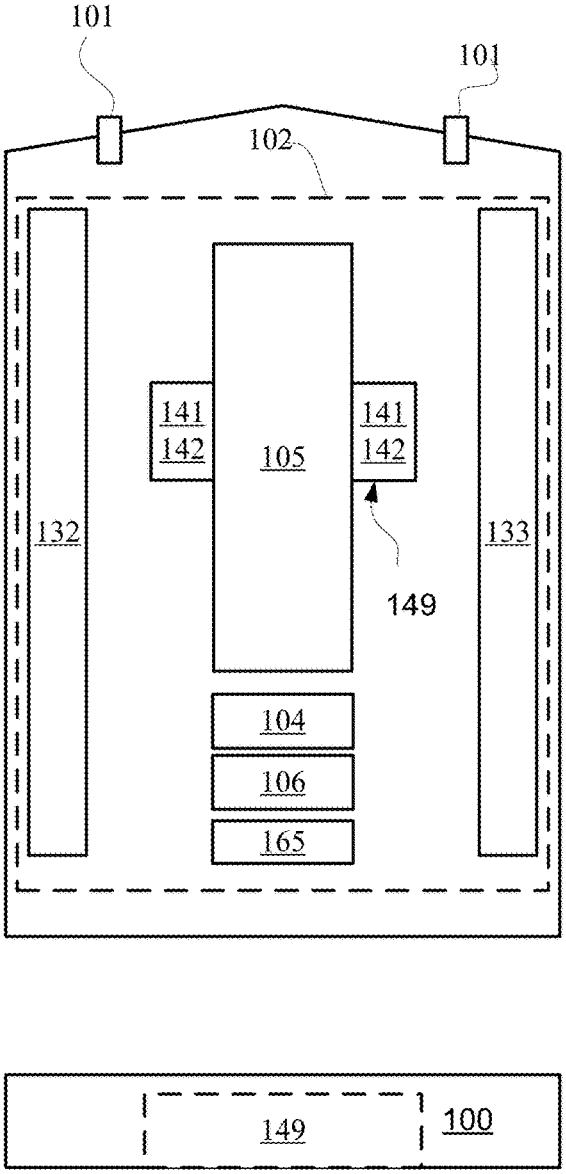

In the following detailed description, numerous specific details are set forth in order to provide a thorough understanding of the invention. However, it will be understood by those skilled in the art that the present invention may be practiced without these specific details. In other instances, well-known methods, procedures, and components have not been described in detail so as not to obscure the present invention.

The subject matter regarded as the invention is particularly pointed out and distinctly claimed in the concluding portion of the specification. The invention, however, both as to organization and method of operation, together with objects, features, and advantages thereof, may best be understood by reference to the following detailed description when read with the accompanying drawings.

It will be appreciated that for simplicity and clarity of illustration, elements shown in the figures have may or may not be drawn to scale. For example, the dimensions of some of the elements may be exaggerated relative to other elements for clarity. Further, where considered appropriate, reference numerals may be repeated among the figures to indicate corresponding or analogous elements.

Any reference in the specification to a modular boat should be applied mutatis mutandis to a method for assembling and/or disassembling the modular boat.

There may be provided a modular boat that is easy to assemble and disassemble.

The modular boat may be at an assembled state in which is ready to sail, or in a disassembled state in which it can be easily carried by a single person.

The modular boat may include a main body that does not substantially change during the assembling and the disassembling process—it does not fold and may have a one-part frame that may be rigid—thereby increasing the durability of the main body and the modular boat.

The assembly process is very simple and can mainly include (i) inflating inflatable floating elements and detaching (via first mechanical interfaces) the inflatable floating elements to the main body, (ii) moving a boat control unit to a modular boat drivable position.

FIGS. 1-6 illustrate examples of modular boats—whereas the modular boats are illustrated in an assembled state and in a disassembled state.

The modular boat 10 may include (a) a main body 100 that is hollow and has suitcase like dimensions (has an overall size or volume that may be of the size of a suitcase—for example length that may reach up till 130 centimeters, width up to 90 cm, height (when in the disassembled state)—up to 40 cm (but may have other dimensions); (b) inflatable floating elements 131 and 132 that are detachable coupled to the main body via first mechanical interfaces 133, (c) a boat control unit 110 that is movably coupled to the main body and is configured to move between a first position to a second position, the first and second positions differ from each other by at least a distance of a distal part of the boat control unit from the main body; (d) a propulsion unit 140.

When the modular boat is at a disassembled state, the one or more inflatable floating elements are not detachably coupled to the main body.

The main body may include wheels 101.

The main body 100 may include one or more storage spaces 102.

The one or more storage spaces may store (at least when in a disassembled state) at least some of the following:

a. The inflatable floating elements 131 and 132 (when not inflated).
b. At least a first portion of a propulsion unit 140.
c. An inflating unit 104 that is configured to inflate the inflatable floating elements.
d. A power unit 105.

Referring back to the boat control unit 110—the distal part may include an control element and/or interface with a human user such as a handle 113, gear shifter, gas knob 114, and the like—for controlling any aspect of the movement of the modular boat—for example—rotational speed of one or more propellers, direction of movement, and the like. If the propulsion unit has motors and propellers—different motors may be independently controlled—or controlled together.

In various figures the boat control unit is illustrated as including a distal part that is mechanically coupled to a movable element such as a movable rod—especially a rotatable rod 112.

The distal part is movably coupled (for example is rotatably coupled—configured to perform pitch axis rotation) between the first position and the second position.

The first and second positions differ from each other by at least a distance of a distal part of the boat control unit from the main body.

For example—the first position may be a closed position in which the boat control unit (or at least the distal part) is attached to the main body or in contact with the main body—or attached to a second interfacing element 111.

In the first position the boat control unit—for example the rotatable element—may be used as a handle for carrying the modular boat—when at the disassembled state.

In the second position—the rod is spaced apart from the body—and may be perpendicular to the body or any other angle—as set by the user. The rotatable element may be of an adjustable length—and can be lowered of elevated.

The handle is may be mechanically coupled to a rotatable element that is rotatable, by the handle, about a yaw axis—thereby controlling the direction of progress of the modular boat—when the modular boat is at the assembled state.

The modular boat may include an inflating unit that is configured to inflate the one or more inflatable floating elements.

The main body is configured to store the one or more inflatable floating elements, when the modular boat is at the disassembled state.

The modular boat may have recesses 108 for receiving the first mechanical interfaces—when shaped to fit within the recesses. The recesses may be of any shape—for example may be delimited by a slot that is narrower than the height of the internal space formed by the recesses.

The modular boat may include a chair 151. That chair may be a height adjustable chair.

The modular boat may include a propulsion unit that has a first portion that comprises propellers, wherein the first portion is configured to move between a third position and a fourth position, wherein the third and fourth positions differ from each other by at least a distance of the propellers from the main body.

The propellers may be at least partially surrounded by the main body when the first portion is positioned at the third position.

The modular boat may include a step 161 or a ladder or any elevating element that can be stepped by on a user—and allow the user to mount the modular boat.

The main body may include a curved upper surface. See, for example, the side view of the modular boat—that shows an elevated rear portion 152 and an elevated front part 154—and a recess formed at the center (along the longitudinal axis of the main body) of the modular boat. See, for example, the recess 155 formed at the center (along the transversal axis) of the modular boat.

The modular boat may include a power unit 106. The power unit may be located within the main body—or may be at least partially located outside the main body.

The main body may be non-foldable.

The main body may include a rigid one-part exterior frame.

Figure 6:
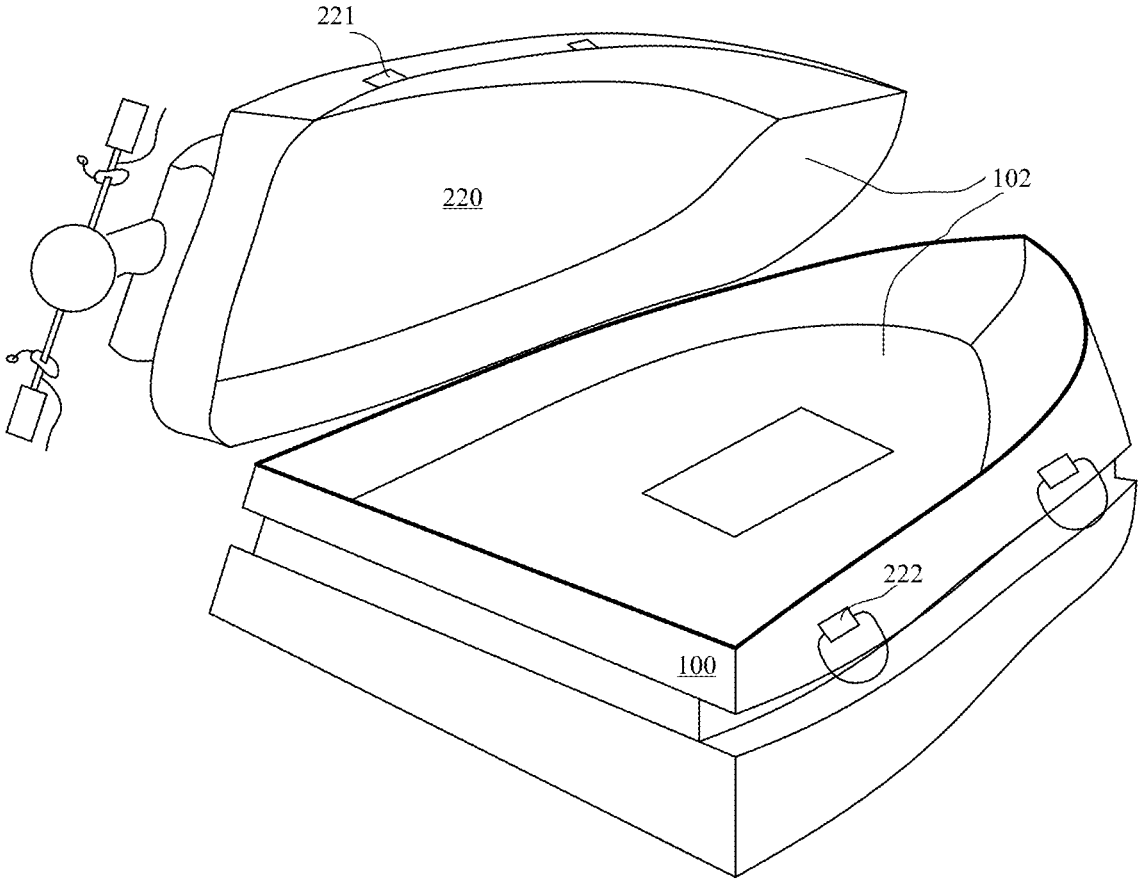

The main body is rotatably connected to au upper part 200 that can selectively open by rotation—over axes (not shown) to expose the one or more storage spaces—as illustrated in FIG. 6. Once closed—the upper part 200 and the main body may be connected to each other and/or fastened to each other and/or locked to each other using any fastening mechanism—such as upper protrusion 221 (of the upper part 100) that can be interfaced by a frame that in turn is connected to the main body (frame and connecting element of frame are denoted 222).

Figure 5:
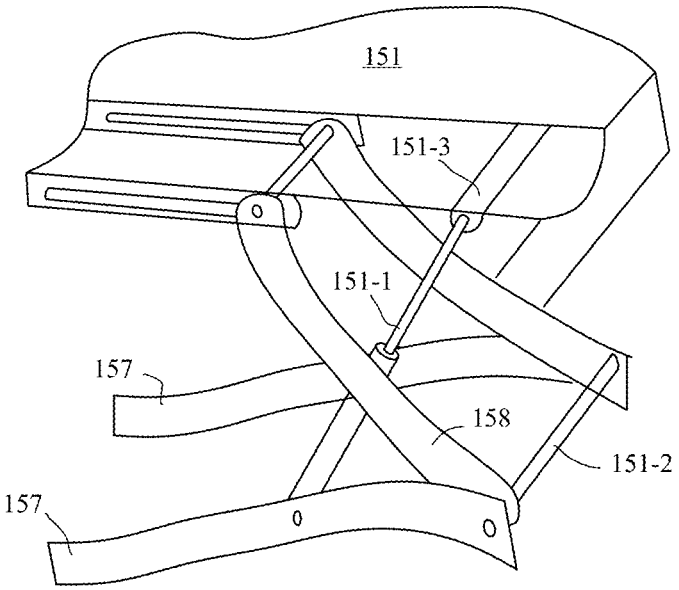

The chair (see FIG. 5) may be positioned in an erect position and in a lower position. FIG. 5 illustrates chair 151 that includes an inner bar 151 that can support a telescopic rod 151-1 that can move along lower rails 157 thereby causing support element 158 to rotate about axis 151-2 and lower or elevate the chair.

Figure 4:
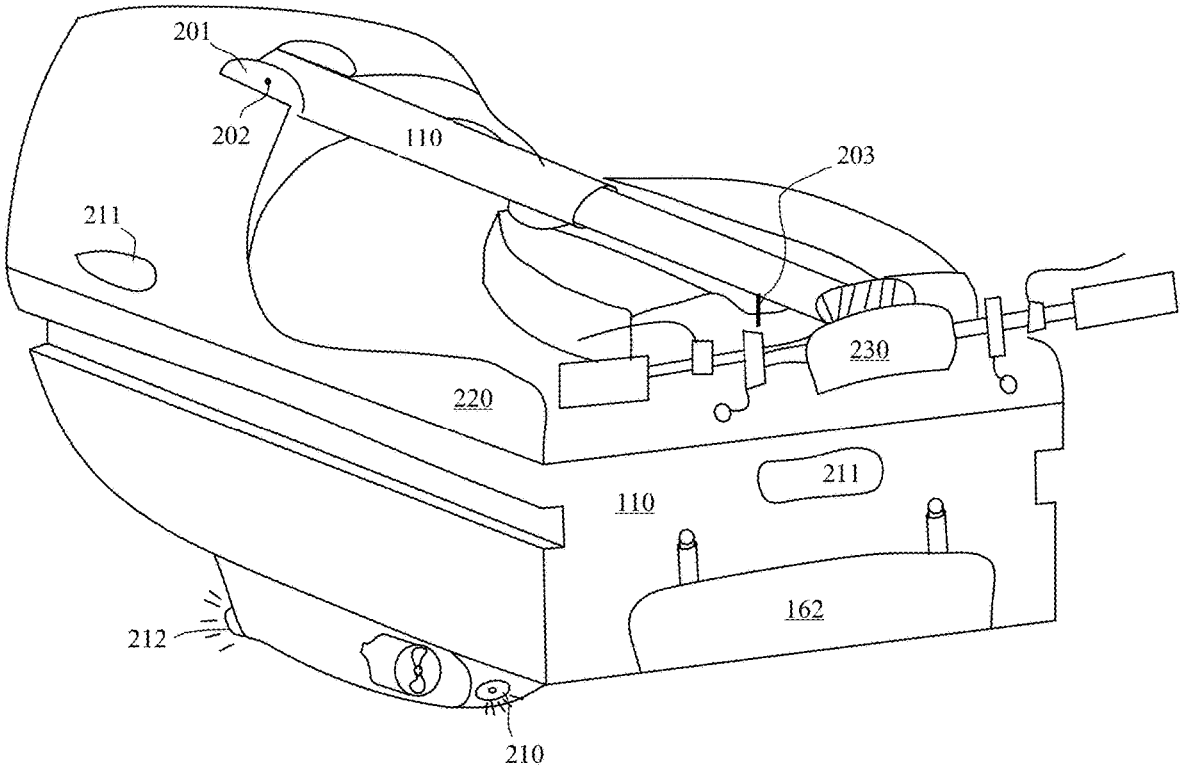

FIG. 4 illustrates the modular boat may include light sources 211 and/or loudspeakers 212 and/or sensors 210—the sensor may sense the underwater environment and above water environment and may detect and generate an alert if underwater obstacle and/or above water obstacles are near the boat.

The rotatable rod 112 may also move between an open position (away from the main body) and a close position (in contact or very close to the main body) in which is extends out of the main body and can be used as a handle that may be carried by a user. The rotatable rod may be selectively locked to the main body (when in closed position) using a locking mechanism 203 that may be selectively locked or unlocked. Any locking mechanism may be used.

The modular boat can be made from lightweight materials such as carbon, while the rotatable rod can be made of aluminum.

The modular boat can weigh between 4 and 9 kilograms—for example may weight about 5 kilogram.

The modular boat may include a display 230 (see FIG. 4).

In the foregoing specification, the invention has been described with reference to specific examples of embodiments of the invention. It will, however, be evident that various modifications and changes may be made therein without departing from the broader spirit and scope of the invention as set forth in the appended claims.

Moreover, the terms "front," "back," "top," "bottom," "over," "under" and the like in the description and in the claims, if any, are used for descriptive purposes and not necessarily for describing permanent relative positions. It is understood that the terms so used are interchangeable under appropriate circumstances such that the embodiments of the invention described herein are, for example, capable of operation in other orientations than those illustrated or otherwise described herein.

Any arrangement of components to achieve the same functionality is effectively "associated" such that the desired functionality is achieved. Hence, any two components herein combined to achieve a particular functionality may be seen as "associated with" each other such that the desired functionality is achieved, irrespective of architectures or intermedial components. Likewise, any two components so associated can also be viewed as being "operably connected," or "operably coupled," to each other to achieve the desired functionality.

However, other modifications, variations and alternatives are also possible. The specifications and drawings are, accordingly, to be regarded in an illustrative rather than in a restrictive sense.

In the claims, any reference signs placed between parentheses shall not be construed as limiting the claim. The word 'comprising' does not exclude the presence of other elements or steps then those listed in a claim. Furthermore, the terms "a" or "an," as used herein, are defined as one or more than one. Also, the use of introductory phrases such as "at least one" and "one or more" in the claims should not be construed to imply that the introduction of another claim element by the indefinite articles "a" or "an" limits any particular claim containing such introduced claim element to inventions containing only one such element, even when the same claim includes the introductory phrases "one or more" or "at least one" and indefinite articles such as "a" or "an." The same holds true for the use of definite articles. Unless stated otherwise, terms such as "first" and "second" are used to arbitrarily distinguish between the elements such terms describe. Thus, these terms are not necessarily intended to indicate temporal or other prioritization of such elements. The mere fact that certain measures are recited in mutually different claims does not indicate that a combination of these measures cannot be used to advantage.

Any reference to consisting or having should be applied mutatis mutandis to consisting.

Any reference to consisting or having should be applied mutatis mutandis to consisting essentially of.

While certain features of the invention have been illustrated and described herein, many modifications, substitutions, changes, and equivalents will now occur to those of ordinary skill in the art. It is, therefore, to be understood that the appended claims are intended to cover all such modifications and changes as fall within the true spirit of the invention.

I claim:

1. A modular boat, comprising:

a main body that is hollow and has suitcase dimensions;

inflatable floating elements that are detachable coupled to the main body via first mechanical interfaces;

a boat control unit that is movably coupled to the main body and is configured to move between a first position to a second position, the first and second positions differ from each other by at least a distance of a distal part of the boat control unit from the main body;

a propulsion unit;

wherein a when the modular boat is at a disassembled state, the one or more inflatable floating elements are not detachably coupled to the main body.

2. The modular boat according to claim 1 wherein the main body comprises wheels.

3. The modular boat according to claim 1, wherein the main body comprises a storage space for storing the one or more inflatable floating elements.

4. The modular boat according to claim 1, wherein the distal part of the boat control unit is a handle.

5. The modular boat according to claim 4, wherein the handle is mechanically coupled to a rotatable element that is rotatable, by the handle, about a yaw axis.

6. The modular boat according to claim 5, wherein the rotatable element is also rotatable about a pitch axis, between the first position and the second position.

7. The modular boat according to claim 6, wherein the handle is mechanically coupled to a rod having an adjustable height.

8. The modular boat according to claim 1, wherein the boat control unit is configured to form a handle of the modular boat when the modular boat is at the disassembled state.

9. The modular boat according to claim 1 comprising an inflating unit that is configured to inflate the one or more inflatable floating elements.

10. The modular boat according to claim 9, wherein the main body is configured to store the one or more inflatable floating elements, when the modular boat is at the disassembled state.

11. The modular boat according to claim 1 wherein the main body comprises recesses for receiving the first mechanical interfaces.

12. The modular boat according to claim 1 comprising a chair.

13. The modular boat according to claim 1 wherein the chair is a height adjustable chair.

14. The modular boat according to claim 1 wherein the propulsion unit comprises a first portion that comprises propellers, wherein the first portion is configured to move between a third position and a fourth position, wherein the third and fourth positions differ from each other by at least a distance of the propellers from the main body.

15. The modular boat according to claim 14 wherein the propellers are at least partially surrounded by the main body when the first portion is positioned at the third position.

16. The modular boat according to claim 1 comprising a step or a ladder.

17. The modular boat according to claim 1 wherein the main body comprises a curved upper surface.

18. The modular boat according to claim 1 comprising a power unit.

19. The modular boat according to claim 1 comprising a power unit that is located within the main body.

20. The modular boat according to claim 1 wherein the main body is non-foldable.

21. The modular boat according to claim 1 wherein the main body comprises a rigid one-part exterior frame.

* * * * *